United States Patent [19]

White

[11] Patent Number: 4,961,520

[45] Date of Patent: Oct. 9, 1990

[54] CO-DISPENSING CONTAINER AND METHOD OF FILLING SAME

[75] Inventor: Douglas J. White, Oceanport, N.J.

[73] Assignee: Bio-Pak Associates, Farmingdale, N.J.

[21] Appl. No.: 178,274

[22] Filed: Apr. 6, 1988

[51] Int. Cl.[5] ..... B67D 5/52

[52] U.S. Cl. ..... 222/135; 222/319; 222/321

[58] Field of Search ..... 222/135–137, 222/319–321, 153

[56] References Cited

U.S. PATENT DOCUMENTS

| | | | |
|---|---|---|---|
| 2,349,005 | 5/1944 | Roe | 222/135 X |
| 4,050,612 | 9/1977 | Stone | 222/135 |
| 4,220,261 | 9/1980 | White | 222/135 |

FOREIGN PATENT DOCUMENTS

| | | | |
|---|---|---|---|
| 1050502 | 2/1977 | Canada | 222/319 |
| E10913II63e | 9/1956 | Fed. Rep. of Germany | 222/137 |

*Primary Examiner*—Andres Kashnikow
*Assistant Examiner*—Kevin P. Weldon
*Attorney, Agent, or Firm*—Lerner, David, Littenberg, Krumholz & Mentlik

[57] ABSTRACT

Dispensing containers are disclosed for simultaneously dispensing flowable products from a common nozzle including a base cup, a plunger cup telescopingly received in the base cup slidable therein upon the application of pressure against the plunger cup, a nozzle communicating with both the base and plunger cups, a piston slidably movable within the plunger cup so that upon slidable movement of the plunger cup within the base cup a flowable product contained with the base cup can be expelled through the nozzle and upon slidable movement of the piston within the plunger cup a flowable product contained within the plunger cup can be expelled through the nozzle, an actuating plunger for actuating the slidable movement of the piston upon application of pressure against the plunger cup, with the actuating plunger preferably being spaced from the piston and engageable with the piston only after the plunger cup has moved a predetermined distance relative to the base cup in order to act to prime the dispenser and prevent premature discharge of the flowable product within the plunger cup. Methods for filling such dispensing containers are also disclosed.

106 Claims, 7 Drawing Sheets

CO-DISPENSING CONTAINER AND METHOD OF FILLING SAME

FIELD OF THE INVENTION

The present invention relates to dispensing containers. More particularly, the present invention relates to improved dispensing containers which are capable of simultaneously dispensing at least two of the same or different products therefrom. Still more particularly, the present invention relates to improved dispensing containers which have telescoping parts including separate chambers for dispensing flowable products therefrom simultaneously. Still more particularly, the present invention relates to methods for filling dispensing containers.

BACKGROUND OF THE INVENTION

There are a considerable number of dispensing containers known in the art for simultaneously dispensing flowable products from two or more dispensing chambers. Two of the most successful efforts to produce such a product are set forth in my prior U.S. Pat. Nos. 4,205,766 and 4,220,261. The dispensing containers shown in these patents render it possible to achieve the production of a dispenser in a rather inexpensive manner, and one which can be assembled and filled in one easy operation on existing types of machinery. In particular, these devices include telescoping dispenser compartments which are operable by means of outside manual pressure to dispense flowable material from these compartments. The dual compartment dispensing container shown in my U.S. Pat. No. 4,205,766 includes a transfer tube integrally formed along the wall of the upper or plunger cup, and a piston 14 which includes a cut-out portion for accommodating the transfer tube. In other embodiments this device also includes locking means for holding the plunger cup in its desired position. The improved device shown in my U.S. Pat. No. 4,220,261 includes a central transfer tube and a piston 40 including an opening for accommodation of that transfer tube centrally thereof. This device also includes means for admitting air between the piston and the upper piston 36 to facilitate relative movement thereof.

As indicated above, the dispensing containers shown in these prior patents, constituted considerable improvements upon previously known dispensing containers. For example, Stone, U.S. Pat. No. 4,050,612, discloses a dispensing container which includes a pair of open-ended containers 12 and 14 nested telescopically and in which the flowable material in the bottom container 12 travels up through a hollow rod 36 which is connected to the piston 26 which slidably moves within the upper container 14. Furthermore, without any venting means this dispensing container is not considered to be operable, and it does not include any means for priming the device. Another dispensing device is shown in Silver, U.S. Pat. No. 4,159,066, in this case including a pair of containers, with the upper container including an integral conduit, and including a separate cover with one of the nozzles therein. Also, Silver, U.S. Pat. No. 4,159,066, discloses a dispensing package which includes an upper container 11, a lower container 1, and a conduit 19 extending through the upper container. Furthermore some recent additional such dispensers include Connors et al, U.S. Pat. No. 4,437,584, which discloses in connection with the embodiment in FIG. 6 thereof, the dual container assembly for dispensing the striped toothpaste therefrom. The device shown therein again includes a central transfer tube and a ratchet assembly for one-way directional use thereof. Also Kluth et al, U.S. Pat. No. 4,334,787 discloses yet another such two component apparatus which includes not only a pair of compartments A and B and another central transfer tube, but also an air gap 27 for permitting air to enter between pistons 23 and 25.

One of the drawbacks in all of these devices is the fact that initial operation of same results in dispensing of products from only one of the dispensers for an initial period of time. This is the result of the shorter path from most of these dispensers to the exit nozzle, and that during initial operation the second dispensing container which is further from the nozzle must operate in a priming step before the material contained therein can be discharged therefrom.

Another significant difficulty with these prior dispensers is the fact that even though the use of means to permit air to enter between the pistons has been disclosed, no such apparatus has been disclosed in a dispenser so that the same aperture can permit both venting during filling of the dispenser and reduction of dispensing pressure between the pistons during use.

Yet another difficulty with the prior dispensing containers in this field has been the fact that in each case the transfer tube extends through a portion of the piston for the upper dispenser, and thus prevents the use of a solid piston having an uninterrupted smooth upper surface in conjunction with such dispensers with a concomitant reduction in possible leakage, etc.

Yet another difficulty with these prior dispensers has been the potential leakage around the piston itself traveling through the upper dispensing container.

Yet another difficulty with these prior dispensers has been the difficulty in filling the separate chambers thereof with different flowable compounds, and doing so without prematurely mixing the two components with each other.

SUMMARY OF THE INVENTION

In accordance with the present invention, it has now been discovered that these and other difficulties with the prior art dispensing containers in this field can be overcome by the preparation of a dispensing container which includes a base cup, a plunger cup telescopingly received in the base cup and relatively slidable therein upon the application of pressure against the plunger cup, nozzle means communicating with both the base cup and the plunger cup, a piston which is slidably movable within the plunger cup, so that upon slidable movement of the plunger cup within the base cup a flowable product contained within the base cup can be expelled through the nozzle means and upon slidable movement of the piston within the plunger cup the flowable product contained within the plunger cup can be expelled through the nozzle means, an actuating plunger for actuating the slidable movement of the piston upon the application of pressure against the plunger cup, and priming means for preventing premature discharge of the flowable product contained within the plunger cup prior to discharge of the flowable product contained within the base cup.

In accordance with a preferred embodiment of this dispensing container of the present invention, the priming means comprises the actuating plunger being initially spaced from the piston and being engageable with the piston only after the plunger cup has moved a predetermined distance relative to the base cup.

In accordance with another preferred embodiment of this dispensing container of the present invention, the priming means comprises the actuating plunger being initially spaced from the bottom of the base cup, and being engageable with the piston only after the plunger cup has been moved a predetermined distance relative to the bottom of the base cup.

In accordance with another embodiment of the dispensing container of the present invention, the plunger cup includes an outer surface having a predetermined outer configuration, and the base cup includes an inner surface with a corresponding predetermined inner configuration so as to facilitate slidable movement between them. In accordance with this embodiment, it is preferred that the plunger cup include a bottom surface, and that the outer surface of the plunger cup include an aperture at a location spaced from that bottom surface, so that the aperture can provide for venting of the plunger cup during filling of the plunger cup with the flowable product and for admission of air between the piston and the bottom surface of the plunger cup to facilitate dispensing of the flowable product from the plunger cup. It is preferred in accordance with this embodiment that the predetermined outer configuration of the outer surface of the plunger cup include at least one longitudinally extending recessed track, and in which the aperture means is located within the track. In a highly preferred embodiment, the aperture is spaced from the bottom surface of the plunger cup a distance such that prior to the slidable movement of the plunger cup within the base cup the aperture is located adjacent to the piston, and the piston thereby covers the aperture.

In accordance with another embodiment of the dispensing container of the present invention, there is provided a base cup, a plunger cup including an outer surface having a predetermined outer configuration and a bottom surface, and being telescopingly received in the base cup and relatively slidable therein upon the application of pressure against the plunger cup, nozzle means communicating with both the base cup and the plunger cup, and a piston having a predetermined shape and being slidably movable within the plunger cup, so that upon slidable movement of the plunger cup within the base cup a flowable product contained within the base cup can be expelled through the nozzle means and upon slidable movement of the piston within the plunger cup a flowable product contained within the plunger cup can be expelled through the nozzle means, the plunger cup including an aperture extending through the outer surface of the plunger cup at a location spaced from the bottom surface of the plunger cup, so that the aperture can provide for venting of the plunger cup during filling of the plunger cup with the flowable product and for admission of air between the piston and the bottom surface of the plunger cup in order to facilitate dispensing of the flowable product from the plunger cup.

In accordance with a preferred embodiment of this dispensing container, the base cup includes an inner surface having a predetermined inner configuration corresponding to the predetermined outer configuration of the plunger cup so as to facilitate slidable movement therebetween. Preferably, the predetermined outer configuration of the outer surface of the plunger cup includes at least one longitudinally extending recessed track, and the aperture is located within that recessed track. Preferably, the plunger cup includes a partitioned area for housing the flowable product and having a predetermined inner surface with a shape corresponding to the predetermined shape of the piston. In a preferred embodiment, the piston includes a continuous, uninterrupted upper surface corresponding to the shape of the inner surface of the partitioned area of the plunger.

In accordance with a preferred embodiment of the dispensing container of the present invention, the nozzle means includes a first nozzle passage extending longitudinally through the plunger cup separate from the partitioned area for communicating with the flowable product contained within the plunger cup, the first nozzle passage having an axis which is located outside of the predetermined inner surface of the partitioned area.

In accordance with another embodiment of the dispensing container of the present invention, there is provided a base cup, a plunger cup telescopingly received in the base cup and relatively slidable therein upon the application of pressure against the plunger cup, nozzle means communicating with both the base cup and the plunger cup, a piston having a predetermined shape and being slidably movable within the plunger cup, so that upon slidable movement of the plunger cup within the base cup a flowable product contained within the base cup can be expelled through the nozzle means and upon slidable movement of the piston through the plunger cup a flowable product contained within the plunger cup can be expelled through the nozzle means, a plunger cup including a partitioned area for housing the flowable product, the partitioned area having a predetermined inner surface with a shape corresponding to the predetermined shape of the piston, and the piston including an uninterrupted upper surface corresponding to the shape of the predetermined surface of the partitioned area of the plunger cup, and wherein the nozzle means includes a first nozzle passage extending longitudinally through the plunger cup separate from the partitioned area communicating with the flowable product contained within the base cup, the first nozzle passage having an axis located outside of the predetermined inner surface of the partitioned area.

In accordance with a preferred embodiment of this dispensing container, there is provided an actuating plunger for actuating the slidable movement of the piston upon application of pressure against the plunger cup, and preferably the plunger cup also includes a bottom surface, and the dispenser includes a sealing ring removably attachable to the bottom surface of the plunger cup, and includes an aperture for slidably receiving and guiding the actuating plunger. In a preferred embodiment, the nozzle means includes a second nozzle passage for communicating with the flowable product contained within the plunger cup, and most preferably the first nozzle passage includes a pair of first nozzle passages, each of which has an axis located outside of the predetermined inner surface of the partitioned area.

In accordance with another embodiment of the dispensing container of the present invention, there is provided a base cup, a plunger cup including a bottom surface telescopingly received in the base cup and relatively slidable therein upon the application of pressure against the plunger cup, nozzle means communicating with both the base cup and the plunger cup, a piston slidably movable within the plunger cup, so that upon slidable movement of the plunger cup within the base cup a flowable product contained within the base cup can be expelled through the nozzle means and upon slidable movement of the piston within the plunger cup a flowable product contained within the plunger cup can be expelled through the nozzle means, an actuating plunger for actuating the slidable movement of the piston upon the application of pressure against the plunger cup, and a sealing ring removably attachable to the bottom surface of the plunger cup, and including an aperture for slidably receiving and guiding the actuating plunger.

In accordance with the preferred embodiment of this dispensing container, there is provided priming means for preventing premature discharge of flowable product contained within the plunger cup prior to discharge of the flowable product contained within the base cup.

In accordance with another embodiment of this dispensing container, the sealing ring has a stepped surface including a first annular portion having a first diameter and including an outer surface frictionally engageable with the inner surface of the plunger, a second annular surface having a second diameter and including an outer surface sealingly engageable with the bottom surface of the plunger cup, the second diameter being greater than the first diameter.

In accordance with the method of the present invention, applicant has discovered a method for filling a dispensing container of the type described above, and thus including first and second cup members with first and second flowable products for simultaneous dispensing from a common nozzle means therefor which includes telescopingly receiving the first cup member within the second cup member, filling a plunger cup member through a first end of the first cup member with the first flowable product, inserting a piston into the first end of the plunger cup member, filling the second cup member through the first end of the second cup member with the second flowable product, and sealing the first end of the second cup member.

In accordance with one embodiment of the method of the present invention, the method includes covering the second end of the first cup member with a cover member in order to prevent premature dispersing through the nozzle by the application of pressure to the second end of the second cup member.

In accordance with another embodiment of the method of the present invention, the method includes venting the plunger cup chamber during the filling of the first cup member.

In accordance with another embodiment of the method of the present invention, filling of the first cup member with the first flowable product includes preventing the first flowable product from entering the second cup member. In accordance with a preferred embodiment of the method of the present invention the method includes sealing the first end of the plunger cup member prior to filling the second cup member.

In accordance with another embodiment of the method of the present invention, the method includes telescopingly receiving the first cup member within the second cup member so that the first and second ends of the first and second cup members substantially correspond with each other, and further includes telescopingly separating the first and second cup members so that the first end of the first cup member corresponds with the second end of the cup member subsequent to filling of the plunger cup member.

In another embodiment of the method of the present invention the method includes telescopingly receiving the first cup member within the second cup member so that the first end of the first cup member corresponds with the second end of the second cup member.

DETAILED DESCRIPTION

Figure 1:
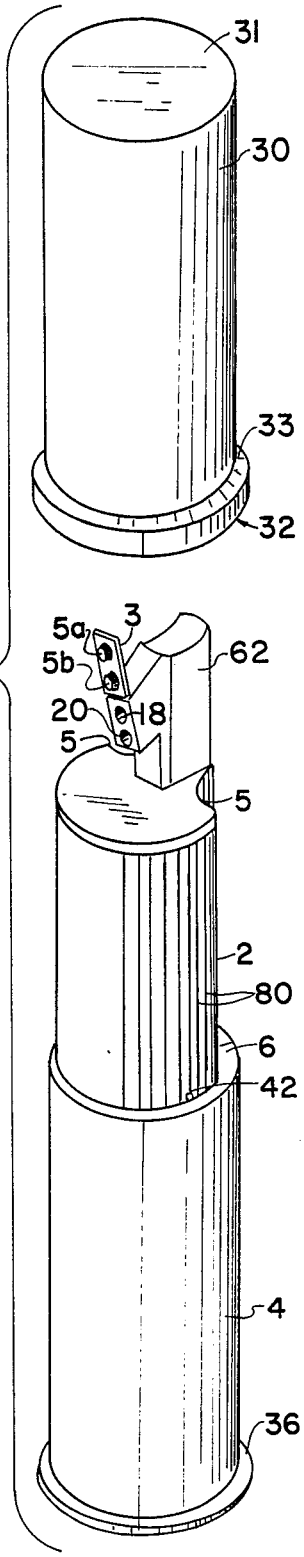
FIG. 1 is an exploded, front, perspective view of a dispensing container assembly in accordance with the present invention.

Referring next to the figures, in which like numerals refer to like portions thereof, FIG. 1 shows a dispensing container assembly constructed according to the principals of the present invention. The overall assembly thus primarily includes a base cup 4 and a plunger cup 2 which is telescopingly received in the base cup. In the embodiment shown in FIGS. 1 and 2 both the base cup 4 and the plunger cup 2 are of a generally cylindrical configuration, but most importantly they have corresponding configurations so that the plunger cup is slidable within the base cup. Thus, in the particular configuration shown in FIGS. 1 and 2, the generally circular configuration of the plunger cup 2 is interrupted by arcuate indentations 5, which are guided within corresponding projections 6 at the upper end of the base cup 4 so as to guide the slidable telescoping movement between the base cup 4 and the plunger cup 2. The upper portion of the plunger cup 2 includes a nozzle 62 from which flowable materials contained within both the base and plunger cups can be simultaneously expelled, as will be discussed in more detail below. The nozzle 62 is closed by a hinged seal 3, which is also discussed below. The lower portion of the plunger cup 2 includes an outwardly extending annular flange 7 which is intended to bridge the distance between the outer wall of the plunger cup 2 and the inner wall of the base cup 4. The flange 7 thus acts as a seal for the purposes of slidably engaging the inner wall of base cup 4 and thus "wiping" that wall during use, as discussed more fully below.

The plunger cup 2 includes a separate partitioned upper product chamber 26 which is intended to include one of the flowable products to be dispensed in accordance with this invention. Upper product chamber 26 is also of a circular or cylindrical inner configuration, preferably smooth and continuous, and it communicates directly with the nozzle 62 through a dispensing nozzle passage 36 housed in the nozzle 62. The plunger cup 2 also includes a separate dispensing passage 38 which runs longitudinally through the plunger cup 2 without interfering with or entering any portion of the upper product chamber 26.

The base cup 4 is basically composed of a lower product chamber 64, again having a generally cylindrical configuration in this case corresponding to that of the base cup 4 itself. Lower product chamber 64 is intended to include either the same, or, more preferably, a different flowable product which is intended to be dispensed through the nozzle 62.

Figure 2:
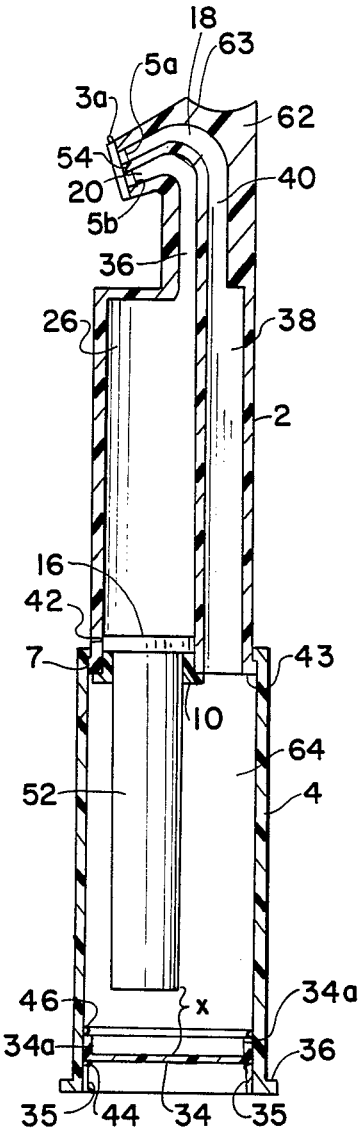
FIG. 2 is a side, elevational, partially sectional view of a portion of the dispensing container assembly of FIG. 1.
Figure 3:
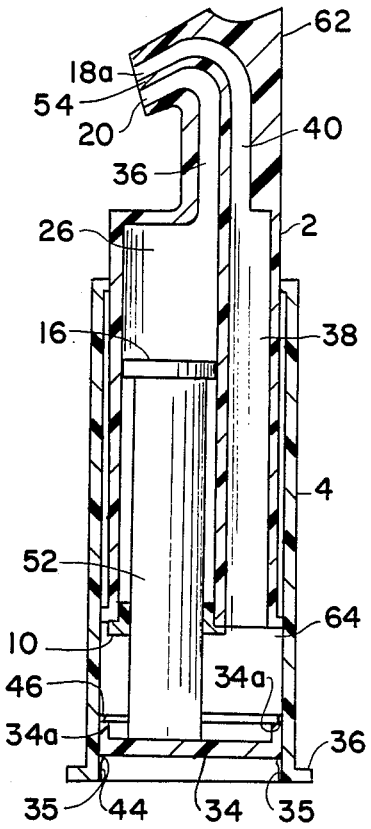
FIG. 3 is a side, elevational, partially sectional view of the dispensing container assembly of FIG. 2, in a partially closed configuration.

The nozzle 62 of the plunger cup 2 thus provides for simultaneous discharge of the flowable materials from both the upper product chamber 26 and the lower product chamber 64. Dispensing passage 38 leads directly into another dispensing nozzle passage 40, and the two dispensing nozzle passages 36 and 40 thus terminate at adjacent exit points 20 and 18, respectively, separated by a wall portion 54, so that the respective flowable materials are essentially simultaneously discharged at that point, but are kept out of direct contact up to that point of discharge. The openings in the nozzle 62 themselves, that is particularly exit points 20 and 18, can be sealed by means of a hinged flap 3 which is hingedly affixed by hinge **3*a* to the upper portion 63 of nozzle 62 at its end. The hinged flap 3 thus extends hingedly and includes two inwardly projecting tab members 5*a* and 5*b*, which are intended to engage the inner wall of the exit points 18 and 20, respectively, when the hinged flap 3 is in a closed position as shown in FIG. 2 hereof. In the open position as shown in FIG. 1 the hinged flap 3 is out of the way of exit points 20 and 18**, and therefore does not interfere with the flow of the flowable material therefrom.

Figure 4:
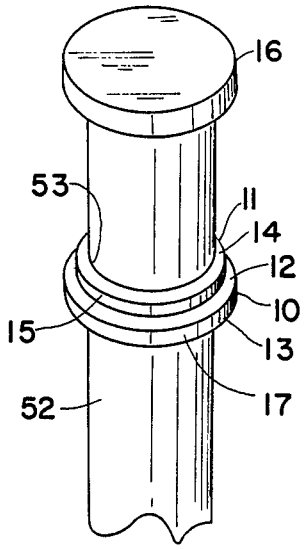
FIG. 4 is a partial, perspective view of a sealing member in conjunction with a portion of the actuating plunger used in the dispensing container assembly of the present invention.

Slidably contained within the upper product chamber 26 is a cylindrical piston 16 adapted for slidable movement within the upper product chamber 26 in a piston-cylinder type arrangement. Piston 16 itself is maintained within the lower portion of the upper product chamber 26 prior to initial activation of the dispensing device hereof by means of sealing ring 10 which is more clearly shown in FIG. 4. Sealing ring 10 includes a stepped configuration which includes an upper annular portion 11 and a wider, lower annular portion 13, and in which the upper annular portion 11 includes a top annular surface 14, and the lower annular portion 13 includes a top annular surface 12. Top annular surface 14 terminates in a descending annular wall 15, and similarly top annular surface 12 terminates in descending annular wall 17. The diameter of upper annular portion 11, as represented by descending annular wall 15, essentially corresponds to the inner diameter of the upper product chamber 26, so that the descending annular wall 15 can frictionally engage the inner wall of upper product chamber 26. Furthermore, the diameter of lower annular portion 13, as represented by descending annular wall 17, is substantially greater than the inner diameter of product chamber 26. When the sealing ring 10 is thus inserted into the bottom opening in plunger cup 2 defining upper product chamber 26, in the manner shown in FIG. the descending annular wall 15 frictionally engages the inner diameter of the upper product chamber 26 and maintains the sealing ring in that position. In addition, the top annular surface 12 then abuts against the bottom portion of the walls defining upper product chamber 26, therefore creating a seal thereabout. The overall sealing ring 10 is annular and includes a central opening 53. An activating plunger 52, having a generally cylindrical configuration, and a diameter which substantially corresponds to the diameter of the central opening 53 in the sealing ring 10, can thus be slidably movable within that central opening 53, as can best be seen in FIG. 4. Activating plunger 52 can either be a separate cylindrical member, or it can be integrally formed with the piston 16. In either case, however, before initial actuation of these dispensing devices, the activating plunger is initially maintained in the configuration shown in FIG. 1, whether it is integral with or in abutment with the lower surface of piston 16, and it is maintained in that position by the frictional engagement with the inner surface of central opening 53 of sealing ring 10.

The bottom portion of the lower product chamber 64 is closed by the presence of bottom member 34. Bottom member 34 is preferably engageable with the bottom of the generally cylindrical opening in the base cup 4 for sealingly closing same. More particularly, bottom member 34 is a one-way locking ring, in that once it is in place, it should not be removable from the base cup 4. This is accomplished by the inclusion of a pair of annular beads 44 and 46 about the inner periphery of the base cap 4. As shown in FIG. 2, the longitudinal dimension of the bottom member 34 corresponds to the distance between these two annular beads 44 and 46. Therefore, by forcing the bottom member 34 over the lower annular bead 44, and into position between the upper and lower annular beads 46 and 44, respectively, the bottom member 34 becomes locked therebetween, and subsequent removal of same is prevented. This is most desirable after the entire filling operation has been completed, as is discussed more fully below. When bottom member 34 is placed in the position shown in FIG. 2 for enclosing lower product chamber 64, since the length of the actuating plunger 52 is less than the overall length of the base cup 4 by a distance designated "x" in FIG. 2, the actuating plunger 52 will essentially remain suspended above the bottom surface 34 prior to use and during an initial period after actuation of these dispensing devices.

The insertion of bottom member 34 into the lower end of the base cup 4 is further facilitated by the presence of longitudinally extending beads 35 along the inner surface of the base cup 4. Two such longitudinally extending beads 35 are shown in FIG. 2, but any number of same can be employed. Their purpose is to separate the outer longitudinal wall 34a of the bottom member 34 from the inner wall of the base cup 4, but only for the short distance travelled by the bottom member 4 as it is being inserted into the lower end of the base cup 4, and only until it reaches its destination between the annular beads 44 and 46. Only a small such separation is required to facilitate this insertion, that is, enough separation to permit air or other gas within the lower product chamber 64 to escape therefrom. This, in turn, prevents the build-up of an overpressure within the lower product chamber 64, which could render it difficult, or impossible, to insert the bottom member 34 into its desired position. A similar longitudinally extending bead can be incorporated into the inner wall at the lower end of the upper product chamber 26 for the purpose of similarly facilitating the insertion of piston 16 into the lower end of the upper product chamber 26. In addition, these longitudinally extending beads, including those designated by reference numeral 35, can alternatively comprise short grooves, such as groove 35a, extending along the inner walls of the upper and lower product chambers for the distance required in accordance with the above discussion thereof.

In accordance with the above-described embodiment, and prior to initial use or actuation of the dispensing devices of this invention, the device is in the configuration as shown in FIGS. 1 and 2, with the upper product chamber 26 and the lower product chamber 64 being filled with flowable product. Furthermore, this configuration can be maintained, and the application of inadvertent pressure against plunger cup 2 can be avoided, by using cover cap 30. This cover cap 30 is generally cylindrical, and includes an upper closed end 31 and an open bottom 32. The depending side walls of cover cap 30 terminate at open bottom 32 with a flanged annular rim 33 with a diameter slightly greater than that of the base cup 4. Also, cover cap 30 has an overall length which is greater than the overall length of the plunger cup 2, so that cover cap 30 can be placed over plunger cup 2, with flanged annular rim 33 resting upon the upper ledge 6 of base cup 4 without contacting plunger cup 2, even in its fully open position prior to actuation. In this manner, any inadvertent contact will be applied against cover cap 30, with no effect upon plunger cap 2, which is therefore fully protected thereby during periods of non-use.

It is also preferred that base cup 4 terminate in a flanged base 36, which provides increased stability to the base cup 4, and thus to the overall device, which can thus stand and remain stable in the configuration as shown in FIGS. 1 and 2.

Figure 5:
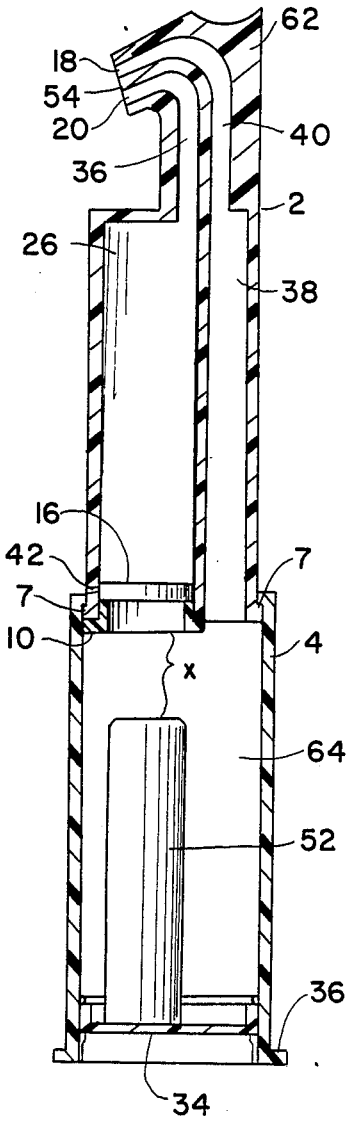
FIG. 5 is a side, elevational, partially sectional view of another embodiment of the dispensing container assembly in accordance with the present invention.

An alternative embodiment of the dispensing devices of this invention is shown in FIG. 5. In this case, the piston 16 and the sealing ring 10 are placed in essentially the same position as is the case in connection with the embodiment shown in FIG. 1. However, the piston 16 and the actuating plunger 52 are separate units. Additionally, the actuating plunger 52 is initially mounted directly on the upper portion of the bottom member 34 at a location in alignment with the central passageway 53 in sealing ring 10, so that upon a downward movement of the plunger cup 2, the actuating plunger 52 will eventually enter central passageway 53 in sealing ring 10 and thus come into contact with the bottom surface of piston 16 within the upper product chamber 26 after an initial period of actuation, or "priming," has occurred, i.e., as the distance "x" is traversed. In order to maintain the actuating plunger 52 in the proper position, several methods can be employed. Firstly, the actuating plunger 52 shown in FIG. 5 can be molded as a single unit along with the bottom member 34. In this manner, so long as the bottom member is properly located upon its application to the base cup 4, the actuating plunger 52 will likewise be properly located. It is also possible to include a circular indentation within the inner face of the bottom member 34 to snugly fit and locate the activating plunger 52 therein. Furthermore, in order to properly locate the actuating plunger 52, even in the case where actuating plunger 52 and bottom member 34 are a single unit, a registration mark or the like can be placed on the lower surface of bottom member 34 at a predetermined location which has a known relationship to the location of the actuating plunger, and to the location of the product chamber 26. By then "reading" the location of this registration mark or the like, the proper orientation of the bottom member 34 can be found so that when it is inserted into the base cup 4 the actuating plunger 52 is properly located below the central passageway 53 in sealing ring 10. These results can be accomplished by other means, however. For example, the bottom member 34 and the side wall of the base cup 4 can include corresponding male and female members so that they must mate with each other in order to slidably interconnect, thus insuring proper orientation of the actuating plunger.

In this case, the length of actuating plunger 52 is again less than the overall length of the base cup 4, and again by a distance "x" shown in FIG. 5.

In both of the embodiments shown in FIGS. 2 and 5, the distance "x" is provided so as to prevent actuation of the piston 16 within upper product chamber 26 during initial downward movement of the plunger cup 2 for a short predetermined period of time. The purpose of this is to effect "priming" of the dispensing passage 38 with a portion of the flowable material initially contained within the lower product chamber 64. This, in turn, can provide for simultaneous discharge of flowable product from both the upper and lower product chambers 26 and 64, respectively.

As can best be seen in FIG. 1, the outer surface of the generally cylindrical plunger cup 2 surrounding the upper product chamber 26 includes a plurality of longitudinally extending recessed tracks 80, so as to produce a surface which appears to be serrated. The presence of these recessed tracks 80, having an overall outer surface which slidably engages a corresponding upper surface of the base cup 4, substantially assists in providing for easy slidable movement between the base cup 4 and the plunger cup 2. This is so because, instead of there being single continuous surfaces in contact with each other, a series of point contacts are provided along the intermittent outer, raised surfaces between each recessed track 80. In addition, within at least one of these recessed tracks 80 there is contained a vent aperture 42, which can best be seen in FIGS. 1 and 2 hereof. The vent aperture 42 is preferably at a location which is displaced a short distance above the lower surface 43 of plunger cup 2, and is preferably placed at a location, as can best be seen in FIG. 2, which is initially aligned with the piston 16. In this manner, prior to any actuation of the dispensing containers hereof, the vent aperture 42 is effectively blocked by the piston 16, and there is no direct contact or passage between the flowable product within the upper product chamber 26 and the atmosphere. However, as soon as the piston 16 begins to move, the vent aperture 42 is uncovered, and as soon as the piston 16 passes vent aperture 42, this aperture can now act to reduce the pressure below the piston 16 and above the sealing ring 10, so as to significantly assist in facilitating further movement of the piston 16 upwardly within upper product chamber 26. Furthermore, prior to filling of the upper product chamber 26, and prior to insertion of the piston 16 into the lower portion of the upper product chamber 26, the vent aperture 42 can provide access to the upper product chamber 26. In this manner, upon initial filling of the upper product chamber 26 with flowable product, vent aperture 42 can provide for venting of any gases initially contained within the upper product chamber 26.

Figure 11A:
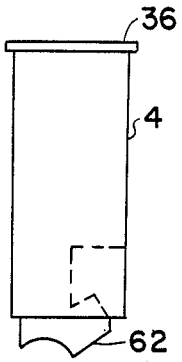
FIGS. 11*a–f* are partially schematic representations of the method of filling the dispensing container assemblies of the present invention.
Figure 11B:
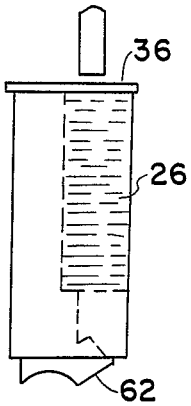

In the operation of the dispensing devices of the present invention, such as those shown in FIGS. 1–5 hereof, these devices can be easily initially filled with flowable product into both the upper chamber 26 and the lower chamber 64. This can now also be done in a far more efficient manner than has previously been the case, and without initial intermixing of flowable products between the two chambers prior to use, referring specifically to FIGS. 11*a–f* and FIGS. 12*a–e* In particular, referring first to FIGS. 1–3 and 11*a–f*, prior to use and prior to insertion and locking of the bottom member 34 into the base cup 4, plunger cup 2 can be telescopingly moved within the base cup 4 in the manner shown in FIGS. 3 and 11*a*, until the plunger cup 2 is entirely contained within base cup 4. More particularly, when the plunger cup 2 is telescoped downwardly into the base cup 4, the outwardly extending flange 7 at the lower end of plunger cup 2 will ultimately engage the upper annular bead 46 projecting inwardly from the inner wall of the base cup 4. In a preferred embodiment, frictional engagement is obtained between the flange 7 and the upper annular bead 46 to maintain the plunger cup 2 in this telescopingly retracted position. In other words, this acts as a temporary locking mechanism, preferably by the inclusion of a small indentation in the outwardly extending flange 7 which frictionally engages the upper annular bead 46. Furthermore, this juxtaposition more positively prevents any flowable material from entering the space between the outer wall of plunger cup 2 and the inner wall of base cup 4, particularly during the filling operation.

This combination of the plunger cup 2 and the base cup 4 are maintained at the appropriate location in the filling apparatus. In this manner, the upper product chamber 26 can now be easily filled with flowable product through the opening in the base cup 4, in the manner shown in FIG. 11*b*, without fear of any of this product entering the lower product chamber 64. In addition, while this is occurring the vent aperture 42 permits venting of any gases within upper product chamber 26 so as to facilitate such filling.

Figure 11C:
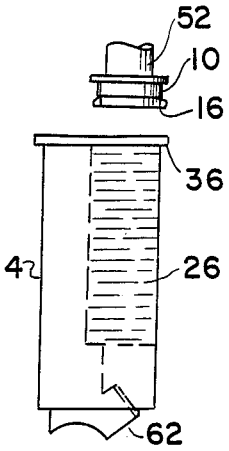
Figure 11D:
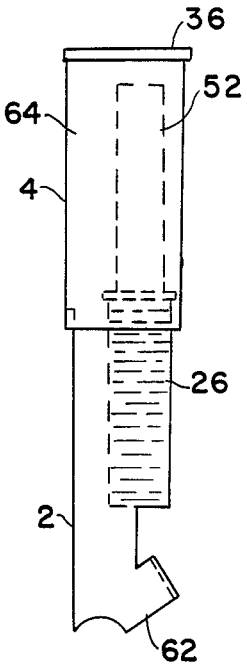
Figure 11E:
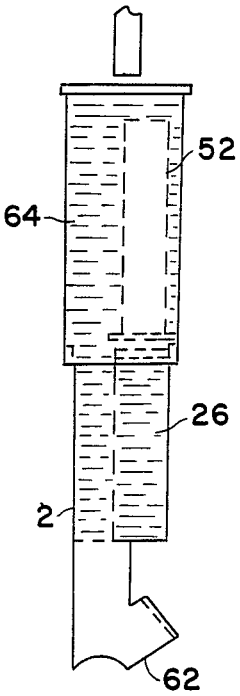
Figure 11F:
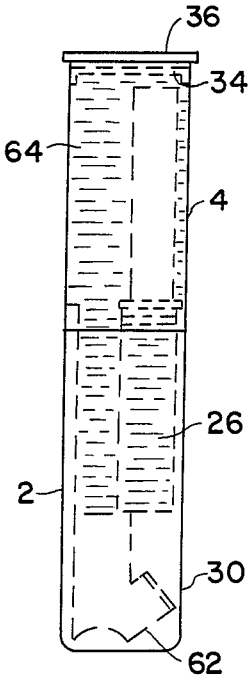

The piston 16, sealing ring 10 and actuating plunger 52, which in the case of the embodiment shown in FIGS. 1–4 is an integral unit with piston 16, are then formed into an assembled unit, as shown in FIG. 11*c*. After the upper product chamber 26 has thus been filled, this assembled unit, including the piston 16, is then placed in the lower end of the upper product chamber 26, with piston 16 in frictional engagement with the inside wall thereof, and sealing ring 10 in position therebelow so as to maintain piston 16 in the proper location as is discussed below, and thus providing for sealable closure of the upper product chamber 26, and maintenance of the piston 16 in position, again as shown in FIG. 11*c*. Furthermore, in this embodiment, the actuating plunger 52 is maintained in frictional engagement with the central opening 53 of sealing ring 10. This can also be the case where the actuating plunger 52 is a separate unit from the piston 16. The plunger cup 2 can then be extended telescopingly outwardly from the base cup 4 back into the position shown in FIGS. 2 and 11*d*. It is then quite easy to fill the lower product chamber 64 with flowable product for use therein, and surrounding the actuating plunger 52, as shown in FIG. 11*e*. After such filling, the base cup 4 can then be sealed by placement of the bottom member 34 within the bottom opening for sealable engagement therewith, as shown in FIG. 11*f*, and the cover cap 30 can then also be applied thereto. The dispensing device of the present invention is then ready for use. In particular, upon removal of the cover cup 30 and initial application of downward pressure applied to the nozzle 62, or the top portion of the plunger cup 2, the outer surface of the lower end 43 of plunger cup 2 moves downwardly along the inner surface of the base cup 4, thus reducing the overall size of the lower product chamber 64 and forcing flowable product upwardly through dispensing passage 38. At that time, the piston 16, actuating plunger 52, and sealing ring 10 move downwardly through the distance "x'" which initially separated the bottom of actuating plunger 52 from the upper surface of bottom member 34, as the plunger cup 2 moves downwardly as discussed above. However, since during this initial movement piston 16 is not urged to move upwardly within upper dispensing chamber 26, none of the flowable product contained within dispensing chamber 26 is forced outwardly toward discharge opening 20. Thus, during movement through the distance "x" the flowable product contained within the lower product chamber 64 is "primed" towards discharge opening 18. By selecting an appropriate initial distance "x," as soon as this flowable product reaches a predetermined location approaching exit port 18, the entire distance "x" will have been traversed, and the actuating plunger 52 will have contacted the upper surface of the bottom member 34. Thus, further downward movement of the plunger cup 2 will now cause the actuating plunger 52 t o urge piston 16 upwardly along the walls of the upper product chamber 64 as the outer cylindrical surface of the actuating plunger 52 slidably moves within the central opening 53 of sealing ring 10. This, in turn, forces flowable product within the upper product chamber 26 towards discharge opening 20, and again by proper selection of the distance "x" both the flowable product in the lower product chamber 64 and the flowable product in the upper product chamber 26 will now simultaneously exit from openings 18 and 20, respectively.

Figure 12A:
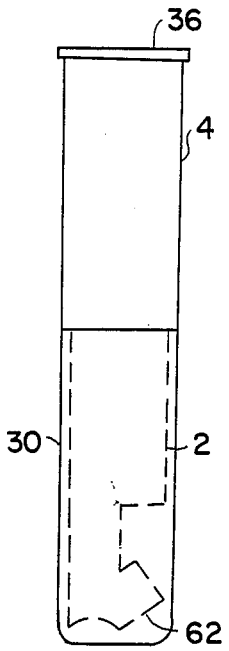
FIGS. 12*a–e* are partially schematic representations of another method of filling the dispensing container assemblies of the present invention.
Figure 12B:
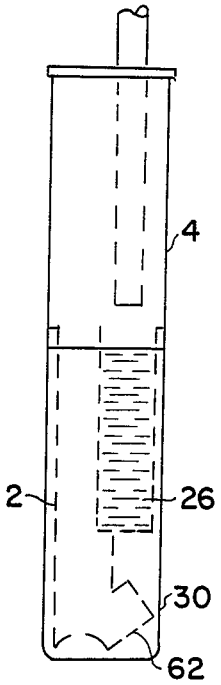

An alternative filling procedure particularly adapted for filling the embodiment shown in FIG. 5 is illustrated in FIGS. 12*a–e*. In this case, the plunger cup 2 and base cup 4 can be initially maintained in their non-telescoped configuration, as shown in FIGS. 5 and 12*a*. In this configuration the flange 7 at the lower end of plunger cup 2 rests against the inwardly directed flange 6 at the upper end of the base cup 4. This configuration of the plunger cup 2 and the base cup 4, and preferably also including the cover cap 30, can be loaded into the appropriate location in the filling apparatus. The upper product chamber 26 can now be filled with flowable product through the opening in the base cup 4 in the manner shown in FIG. 12*b*. Once again in this case, during this procedure the vent aperture 42 permits venting of gases within the upper product chamber 26.

Figure 12C:
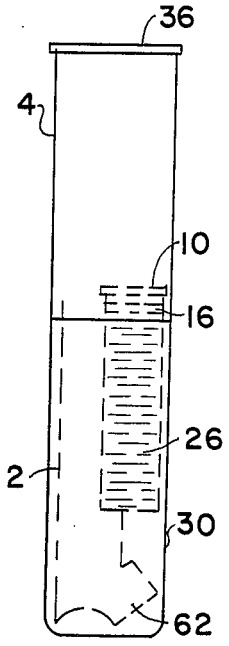
Figure 12D:
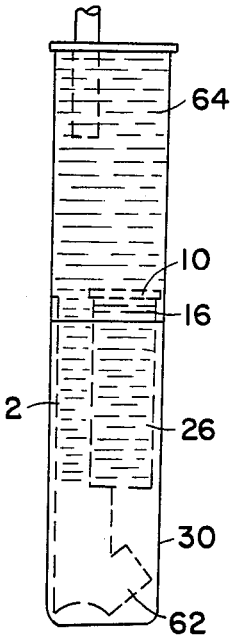
Figure 12E:
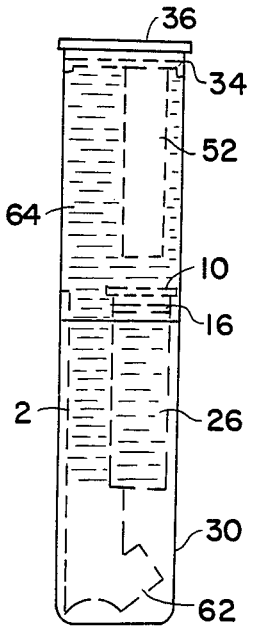

The combination of piston 16 and sealing ring 10 can then be placed into the lower opening in the upper product chamber 26 in the plunger cup 2, in the manner shown in FIG. 12*c*. This insertion can be facilitated by the presence of longitudinally extending beads along the inner wall at the lower end of the upper product chamber 26, in the manner discussed above. The lower product chamber 64 in the base cup 4 can then be filled with flowable product, again preferably a different flowable product, in the manner shown in FIG. 12*d*. After such filling the combination of bottom member 34 and actuating plunger 52, which can be an integral unit or a two-piece construction as discussed above, can then be placed into the bottom opening of the base cup 4 to sealingly engage same, in the manner shown in FIG. 12*e*. Once again, insertion of the bottom member 34 can be facilitated by the presence of longitudinally extending beads 35 along the inner wall at the lower end of the lower product chamber 64. This dispensing device is then ready for use.

Figure 6:
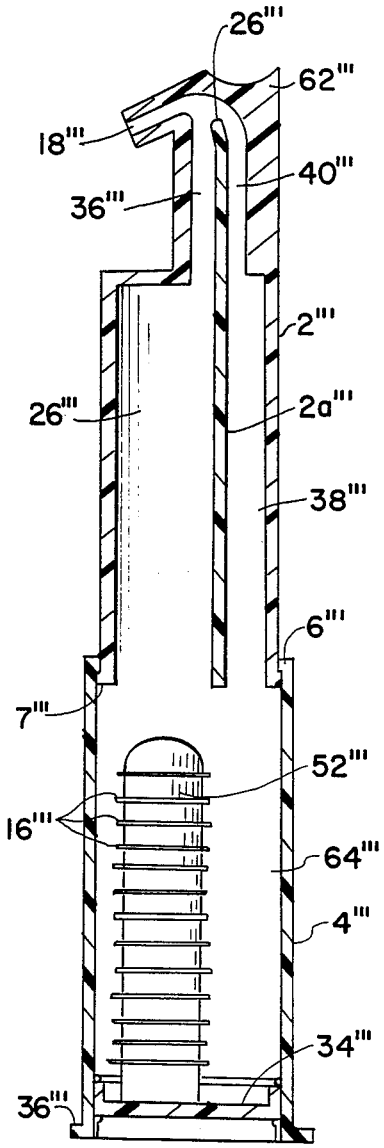
FIG. 6 is a side, elevational, partially sectional view of another embodiment of the dispensing container assembly in accordance with the present invention.

Another embodiment of the dispensing container of the present invention is shown in FIG. 6 hereof. In this embodiment, once again, corresponding reference numerals which include the designation ''' are intended to correspond to like elements in the embodiment shown in FIGS. 1–5. In this embodiment, however, the container is specifically intended to be used only with the single flowable product in both upper product chamber 26''' and lower product chamber 64'''. In this case, there is thus no use for a separate sealing member 10, as is included in the container of FIGS. 1–3 for example. As can thus be seen, the bottom end of upper product chamber 26''' in this case is completely open. In addition, a single piston 16 as used in the previous embodiment is not employed in this case. Instead, a number of pistons 16''' are mounted along actuating rod 52''', in this case mounted on the bottom member 34''' in the manner discussed above, i.e., either as an integral unit or separately mounted thereon. The other elements in the container shown in FIG. 6 again correspond to those discussed above. In this case, upon downward movement of the plunger cup 2''', the initial or uppermost one of the pistons 16''' will eventually enter the lower opening in the upper product chamber 26''' and begin to force flowable product therewithin through passage 36''' and into nozzle opening 18'''. In addition, as the plunger cup 2''' continues to move downwardly into the base cup 4''', additional flowable material initially contained within the lower product chamber 64''' will move through passageway 38''', similarly through nozzle opening 18'''. As the plunger cup 2''' continues to move downwardly into the base cup 4''', the actuating plunger 52''' will continue to urge successive ones of the pistons 16''' upwardly into the upper product chamber 26'''. This will prevent a significant amount of the flowable product contained within the lower product chamber 64''' from entering the lower portion of the upper product chamber 26''' as this process continues. Thus without additional such pistons 16''' a significant amount of the flowable product would follow the initial piston 16''' along the outer surface of the actuating rod 52''' and be wasted.

Figure 3A:
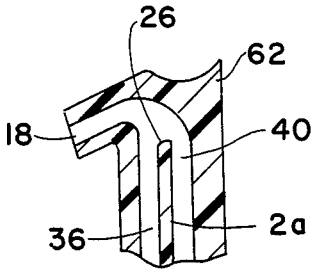
FIG. 3*a* is a side, elevational, sectional view of a portion of a nozzle for use in connection with the dispensing container assembly of the present invention.

The upper portion of the embodiment of the dispensing device of the invention shown in FIG. 6 can be more clearly seen in FIG. 3*a*, and permits intermixing of the flowable product from the upper and lower dispensing chambers prior to their exit from a common nozzle 18 or 18''', irrespective of whether or not this is a single or two different flowable materials. This is accomplished by shortening the extension of the inner wall of the upper product chamber 26 in the plunger cup 2 so that it ends at an upper end 2*b* and 2*b'''*, thus permitting flowable material from passages 36 and 40, and 36''' and 40''' in the case of the dispenser in FIG. 6, to intermix before they exit common exit point 18 and 18''', respectively.

Figure 7:
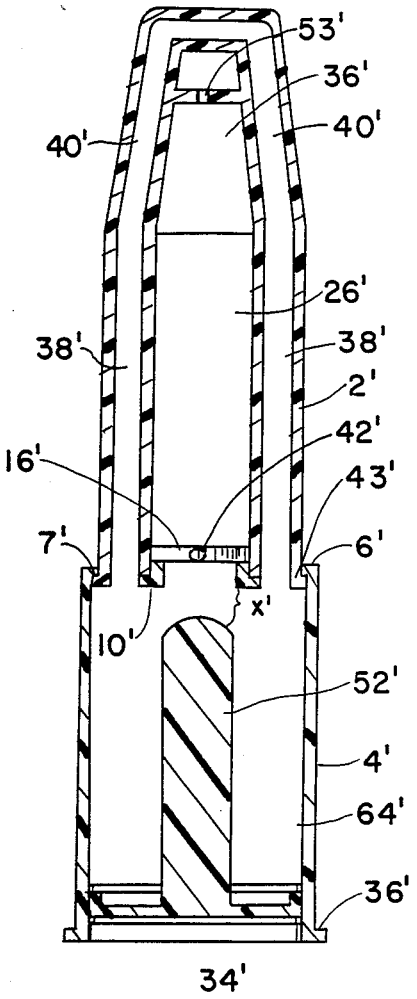
FIG. 7 is a side, elevational, partially sectional view of another embodiment of the dispensing container assembly in accordance with the present invention.
Figure 8:
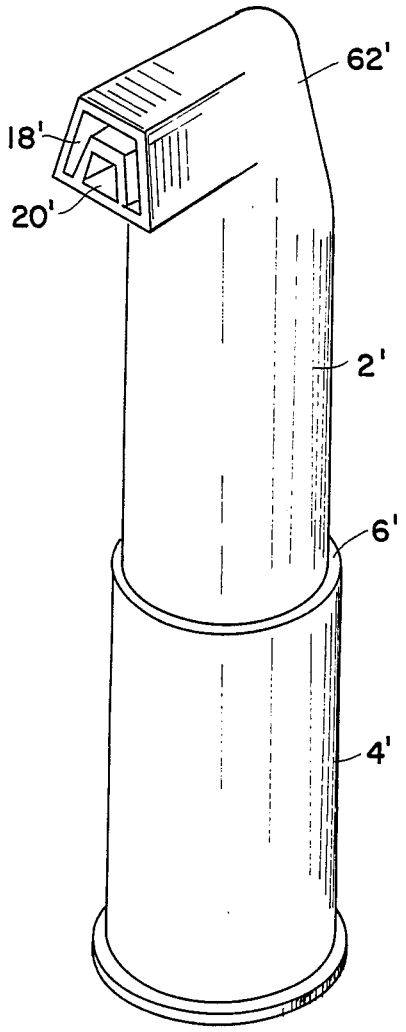
FIG. 8 is a front, elevational, perspective view of the embodiment of the dispensing container assembly of the present invention as shown in FIG. 7.
Figure 9:
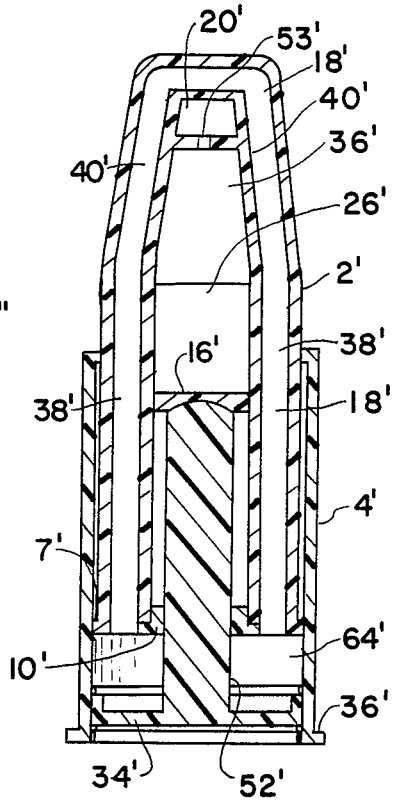
FIG. 9 is a front, elevational, sectional view of the dispensing container assembly of FIG. 7, in a partially closed configuration.

Referring next to FIGS. 7 through 9, yet another embodiment of the dispensing container of the present invention is shown therein. In this embodiment corresponding reference numerals which include the designation ' are intended to correspond to like elements in the embodiment shown in FIGS. 1 through 5. This device thus includes a base cup 4' and a plunger cup 2' telescopingly slidable therewithin. In this case, the plunger cup 2' includes an upper nozzle 62' for codispensing flowable product therefrom. The plunger cup 2' in this case includes a centrally disposed upper product chamber 26', which is again preferably circular or oval in cross-sectional configuration, and again includes a piston 16' of comparable cross-sectional shape. In this case, however, the plunger cup 2' includes a pair of dispensing passages 38' extending on either side of the upper product chamber 26', but again separate therefrom. These dispensing passages 38' extend into corresponding nozzle passages 40' which then join together in the manner best shown in FIG. 8, so as to exit through a U-shaped nozzle aperture 18'.

On the other hand, the upper product chamber 26' directly opens into a reduced dispensing passage 36', which leads directly through aperture 53' into exit aperture 20', which as can be seen in FIG. 8, is surrounded by the U-shaped exit aperture 18'.

In this embodiment, and particularly where the device has an oval shape, the front and rear portions of the upper product chamber 26' as seen from the cross-section shown in FIG. 7, where there are no dispensing passages 38', thus corresponds to the outer wall surface of the plunger cup 2'. At a location in one of these wall portions is included aperture 42', as can be seen in FIG. 7. In this case the aperture 42' is shown in phantom view, since it is located behind the piston 16', in the position shown in that Figure. The aperture 42' is again present for the purpose of assisting in venting upper product chamber 26' during filling and to permit piston 16' to proceed upwardly therethrough by allowing air to enter below the piston 16' as it so proceeds therein.

The base cup 4' in this case includes an upper rim 6' similar to that in the embodiment shown in FIGS. 1 through 5. In this case the lower end 43' of the plunger cup 2' includes a flared outer surface 7' for slidable contact along the inner surface of the base cup 4' during downward slidable movement of the plunger cup 2' therewithin. The base cup 4' again includes an outwardly flared flange 36' surrounding the bottom member 34' for closing same.

The piston 16' in this case has a particular configuration, which is shown in FIGS. 7 through 9. That is, the piston 16' in this case is again disc-shaped, and is again mounted at the lower end of upper product chamber 26' along with and by means of the sealing ring 10'. Furthermore, mounted on the bottom member 34' within the base cup 4' is actuating plunger 52', which in this case includes a rounded upper surface. The actuating plunger 52' is again shorter than the overall length of the base cup 4' by a distance "x'" as shown in FIG. 7. Thus, based upon the placement of actuating plunger 52', after initial downward movement of plunger cup 2' through the distance "x'", again for the purposes of "priming" passages 38' and 40' with flowable product initially contained in the lower product chamber 64', the upper rounded surface 57' of the actuating plunger 52' engages the piston 16'. Upon further downward movement of the plunger cup 2', the actuating plunger 52' urges piston 16' upwardly through the upper product chamber 26' and flowable product contained therein is dispensed through aperture 20'. Further such downward motion of the plunger cup 2', as can best be seen in FIG. 9, results in co-dispensing of flowable products from the upper product chamber 26' and the lower product chamber 64' simultaneously through the nozzle 62' and in particular through nozzle passages 20' and 18', respectively.

Figure 10:
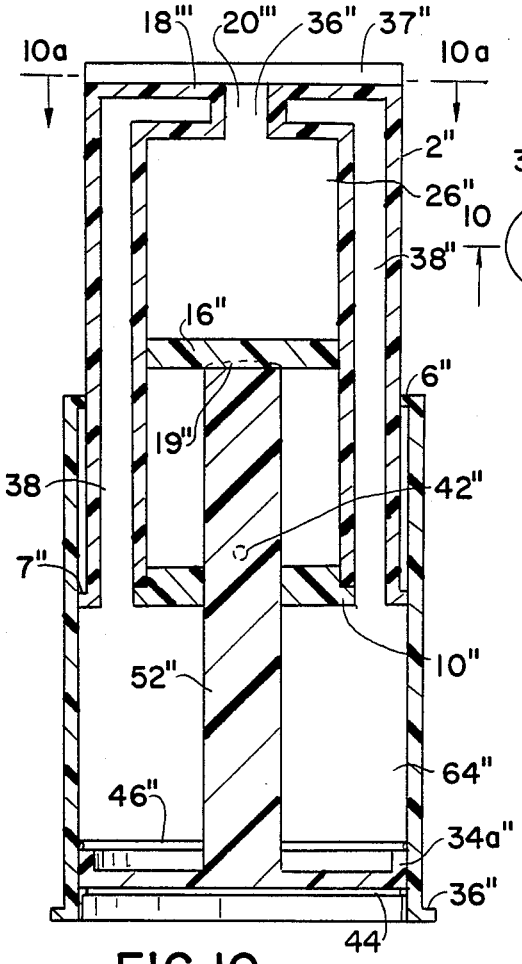
FIG. 10 is a front, elevational, sectional view of another embodiment of the dispensing container assembly of the present invention.
Figure 10A:
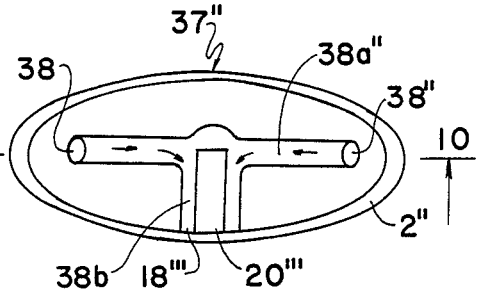
FIG. 10*a* is a top, elevational view of the dispensing container assembly of FIG. 10, taken along line 10*a* thereof.

Referring next to FIGS. 10 and 10*a*, yet another embodiment of the dispensing container of the present invention is shown therein. In this embodiment corresponding reference numerals which include the designation " are intended to correspond to like elements in the embodiments shown in FIGS. 1–5. This embodiment is similar to the embodiment shown in FIGS. 7–9, with one significant difference in that the overall construction has an oval configuration, as can best be seen in FIG. 10*a*, as compared to the cylindrical configuration of the embodiment shown in FIGS. 7–9. Furthermore, the upper or nozzle end of this device is considerably different from that of the devices discussed above.

This device includes a base cup 4" and a plunger cup 2" again telescopingly slidable therewithin. In this case the plunger cup 2" includes an upper surface which can be seen in FIG. 10*a*. This upper surface is open, and intended to be subsequently sealed by cover member 37". The upper surface of plunger cup 2" thus includes a pair of openings into the pair of dispensing passages 38" which extend on either side of the upper product chamber 26". It also includes a central exit aperture 20", which extends directly into the upper product chamber 26". The passageways 38*a*" and 38*b*" connecting the dispensing passages 38" with the exit apertures 18" are thus only closed when the cover member 37" having a corresponding oval configuration is sealed to the top of the plunger cup 2", preferably by adhesive, or other such means. Apart from this the other elements of the base cup 4" and the plunger cup 2" in this case correspond to those in the previous embodiments, including that shown in FIGS. 7–9.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A dispensing container assembly comprising:

a base cup;

a plunger cup telescopingly received in said base cup and relatively slidable therein upon the application of pressure against said plunger cup;

nozzle means communicating with each of said base cup and said plunger cup;

a piston having a predetermined shape and being slidably movable within said plunger cup, whereby upon slidable movement of said plunger cup within said base cup a flowable product contained within said base cup can be expelled therefrom through said nozzle means and upon slidable movement of said piston within said plunger cup a flowable product contained within said plunger cup can be expelled therefrom through said nozzle means;

an actuating plunger for actuating said slidable movement of said piston upon the application of said pressure against said plunger cup; and priming means for preventing premature discharge of said flowable product contained within said plunger cup prior to discharge of said flowable product contained within said base cup.

2. The dispensing container assembly of claim 1 wherein said base cup includes a bottom member.

3. The dispensing container assembly of claim 1 wherein said priming means comprises said actuating plunger being initially spaced from said piston and being engageable with said piston only after said plunger cup has been moved a predetermined distance relative to said base cup.

4. The dispensing container assembly of claim 2 wherein said priming means comprises said actuating plunger being initially spaced from said bottom member of said base cup, and being engageable with said piston only after said plunger cup has been moved a predetermined distance relative to said bottom member.

5. The dispensing container assembly of claim 1 wherein said plunger cup includes an outer surface having a predetermined outer configuration, and said base cup includes an inner surface having a corresponding predetermined inner configuration, thereby facilitating slidable movement therebetween.

6. The dispensing container assembly of claim 5 wherein said plunger cup includes a bottom surface and an aperture extending through said outer surface of said plunger cup at a location spaced from said bottom surface of said plunger cup, whereby said aperture can provide for venting of said plunger cup during filling of said plunger cup with said flowable product and for admission of air between said piston and said bottom surface of said plunger cup to facilitate dispensing of said flowable product from said plunger cup.

7. The dispensing container assembly of claim 6 wherein said predetermined outer configuration of said outer surface of said plunger cup includes at least one longitudinally extending recessed track, and wherein said aperture is located within said recessed track.

8. The dispensing container of claim 6 wherein said aperture is spaced from said bottom surface of said plunger cup a distance such that prior to said slidable movement of said plunger cup within said base cup said aperture is located adjacent to said piston, whereby said piston covers said aperture.

9. The dispensing container of claim 1 wherein said plunger cup includes a partitioned area for housing said flowable product, said partitioned area having a predetermined inner surface having a shape corresponding to said predetermined shape of said piston.

10. The dispensing container of claim 9 wherein said piston includes an uninterrupted upper surface corresponding to said shape of said predetermined inner surface of said partitioned area of said plunger cup.

11. The dispensing container of claim 9 wherein said nozzle means include a first nozzle passage extending longitudinally through said plunger cup separate from said partitioned area for communicating with said flowable product contained within said base cup, said first nozzle passage having an axis located outside of said predetermined inner surface of said partitioned area.

12. The dispensing container of claim 11 wherein said nozzle means further includes a second nozzle passage extending longitudinally through said plunger cup separate from said partitioned area for communicating with said flowable product contained within said base cup, said first and second nozzle passages being on opposite sides of said partitioned area and having axes located outside of said predetermined inner surface of said partitioned area.

13. The dispensing container assembly of claim 1 wherein said plunger cup includes a bottom surface, and including a sealing ring removably attachable to said bottom surface of said plunger cup, said sealing ring including an aperture for slidingly receiving and guiding said actuating plunger.

14. The dispensing container assembly of claim 1 wherein said piston and said actuating plunger are integrally formed into a single unit.

15. The dispensing container assembly of claim 14 including a plurality of said pistons formed along said surface of said actuating plunger.

16. The dispensing container assembly of claim 2 wherein said bottom member is separate from said base cup, and wherein said base cup includes locking means for locking said bottom member into said base cup.

17. The dispensing container assembly of claim 16 wherein said locking means comprises one-way locking means for preventing said bottom member from being removed from said base cup.

18. The dispensing container assembly of claim 17 wherein said one-way locking means comprises a pair of inwardly projecting bead members separated by a distance corresponding to the thickness of said bottom member.

19. The dispensing container assembly of claim 16 wherein said base cup includes a circumferential flange member for providing stability to said base cup.

20. The dispensing container assembly of claim 12 wherein said nozzle means includes a second nozzle passage for communicating with said flowable product contained within said plunger cup.

21. The dispensing container assembly of claim 1 wherein said plunger cup includes an inner surface and said piston is initially disposed at a predetermined location on said inner surface of said plunger cup, and including vent track means in said inner surface of said plunger cup at said predetermined location whereby the creation of an overpressure within said plunger cup during insertion of said piston into said predetermined location is avoided thereby.

22. The dispensing container assembly of claim 21 wherein said vent track means includes a length which is no greater than the thickness of said piston.

23. The dispensing container assembly of claim 22 wherein said vent track means comprises raised guides disposed on said inner surface of said plunger cup.

24. The dispensing container assembly of claim 1 including removable lid means removably covering said nozzle means.

25. The dispensing container assembly of claim 24 wherein said removable lid means includes hinge means for permanently affixing said removable lid means to said plunger cup adjacent to said nozzle means.

26. The dispensing container assembly of claim 1 wherein said plunger cup has a predetermined length, and including cover cap means for covering said plunger cup prior to said slidable movement of said plunger cup within said base cup, said cover cap being a length which is greater than said predetermined length whereby said cover cap prevents premature slidable movement of said plunger cup within said base cup.

27. The dispensing container assembly of claim 26 wherein said cover cap means includes an annular rim for mounting said cover cap means on said base cup.

28. A dispensing container assembly comprising:

a base cup;

a plunger cup including an outer surface having a predetermined outer configuration including at least one longitudinally extending recessed track and a bottom surface, and being telescopingly received in said base cup and relatively slidable therein upon the application of pressure against said plunger cup;

nozzle means communicating with each of said base cup and said plunger cup; and a piston having a predetermined shape and being slidably movable within said plunger cup, whereby upon slidable movement of said plunger cup within said base cup a flowable product contained within said base cup can be expelled therefrom through said nozzle means and upon slidable movement of said piston within said plunger cup a flowable product contained within said plunger cup can be expelled therefrom through said nozzle means; said plunger cup including an aperture located within said recessed track and extending therethrough at a location spaced from said bottom surface of said plunger cup a distance such that prior to said slidable movement of said plunger cup within said base cup said aperture is located adjacent to said piston, whereby said piston covers said aperture and said aperture can provide for venting of said plunger cup during filling of said plunger cup with said flowable product and for admission of air between said piston and said bottom surface of said plunger cup to facilitate dispensing of said flowable product from said plunger cup.

29. The dispensing container assembly of claim 28, wherein said base cup includes an inner surface having a predetermined inner configuration corresponding to said predetermined outer configuration of said plunger cup, thereby facilitating slidable movement therebetween.

30. The dispensing container assembly of claim 28 wherein said plunger cup includes a partitioned area for housing said flowable product, said partitioned area having a predetermined inner surface having a shape corresponding to said predetermined shape of said piston.

31. The dispensing container assembly of claim 30, wherein said piston includes an uninterrupted upper surface corresponding to said shape of said inner surface of said partitioned area of said plunger cup.

32. The dispensing container assembly of claim 30, wherein said nozzle means includes a first nozzle passage extending longitudinally through said plunger cup separate from said partitioned area for communicating with said flowable product contained within said plunger cup, said first nozzle passage having an axis located outside of said predetermined inner surface of said partitioned area.

33. The dispensing container assembly of claim 32 wherein said nozzle means further includes a second nozzle passage extending longitudinally through said plunger cup separate from said partitioned area for communicating with said flowable product contained within said base cup, said first and second nozzle passages being on opposite sides of said partitioned area and having axes located outside of said predetermined inner surface of said partitioned area.

34. The dispensing container assembly of claim 28 including a bottom member lockable within said base cup and forming a bottom wall therefor.

35. The dispensing container assembly of claim 34, wherein said nozzle means includes a pair of nozzle passages for communicating with said flowable product contained within said plunger cup.

36. The dispensing container assembly of claim 28 including an actuating plunger for actuating said slidable movement of said piston upon the application of pressure against said plunger cup.

37. The dispensing container of claim 36 including priming means for preventing premature discharge of said flowable product contained within said plunger cup prior to discharge of said flowable product contained within said base cup.

38. The dispensing container assembly of claim 37 wherein said priming means comprises said actuating plunger being initially spaced from said piston and being engageable with said piston only after said plunger cup has been moved a predetermined distance relative to said base cup.

39. The dispensing container assembly of claim 37 wherein said priming means comprises said actuating plunger being initially spaced from said bottom member of said base cup, and being engageable with said piston only after said plunger cup has been moved a predetermined distance relative to said bottom member.

40. The dispensing container assembly of claim 36 wherein said plunger cup includes a bottom surface, and including a sealing ring removably attachable to said bottom surface of said plunger cup, said sealing ring including an aperture for slidingly receiving and guiding actuating plunger.

41. The dispensing container assembly of claim 36 wherein said piston and said actuating plunger are integrally formed into a single unit.

42. The dispensing container assembly of claim 41 including a plurality of said pistons formed along said surface of said actuating plunger.

43. The dispensing container assembly of claim 37 wherein said bottom member is separate from said base cup, and wherein said base cup includes locking means for locking said bottom member into said base cup.

44. The dispensing container assembly of claim 43 wherein said locking means comprises one-way locking means for preventing said bottom member from being removed from said base cup.

45. The dispensing container assembly of claim 44 wherein said one-way locking means comprises a pair of inwardly projecting bead members separated by a distance corresponding to the thickness of said bottom member.

46. The dispensing container assembly of claim 45 wherein said plunger cup has a predetermined length, and including cover cap means for covering said plunger cup prior to said slidable movement of said plunger cup within said base cup, said cover cap being a length which is greater than said predetermined length whereby said cover cap prevents premature slidable movement of said plunger cup within said base cup.

47. A dispensing container assembly comprising:

a base cup;

a plunger cup telescopingly received in said base cup and relatively slidable therein upon the application of pressure against said plunger cup;

nozzle means communicating with each of said base cup and said plunger cup; and a piston having a predetermined shape and being slidably movable within said plunger cup, whereby upon slidable movement of said plunger cup within said base cup a flowable product contained within said base cup can be expelled therefrom through said nozzle means and upon slidable movement of said piston within said plunger cup a flowable product contained within said plunger cup can be expelled therefrom through said nozzle means, said plunger cup including a partitioned area for housing said flowable product, said partitioned area having a predetermined inner surface having a shape corresponding to said predetermined shape of said piston, said piston including an uninterrupted upper surface corresponding to said shape of said predetermined inner surface of said partitioned area of said plunger cup, and said nozzle means including a first nozzle passage extending longitudinally through said plunger cup separate from said partitioned area for communicating with said flowable product contained within said base cup, said first nozzle passage having an axis located outside of said predetermined inner surface of said partitioned area.

48. The dispensing container assembly of claim 47 wherein said nozzle means further includes a second nozzle passage extending longitudinally through said plunger cup separate from said partitioned area for communicating with said flowable product contained within said base cup, said first and second nozzle passages being on opposite sides of said partitioned area and having axes located outside of said predetermined inner surface of said partitioned area.

49. The dispensing container assembly of claim 47 including an actuating plunger for actuating said slidable movement of said piston upon the application of said pressure against said plunger cup.

50. The dispensing container assembly of claim 49, wherein said plunger cup includes a bottom surface, and including a sealing ring removably attachable to said bottom surface of said plunger cup, said sealing ring including an aperture for slidably receiving and guiding said actuating plunger.

51. The dispensing container assembly of claim 47, wherein said nozzle means includes a second nozzle passage for communicating with said flowable product contained within said plunger cup.

52. The dispensing container assembly of claim 47, wherein said first nozzle passage comprises a pair of first nozzle passages, each having an axis located outside of said predetermined inner surface of said partitioned area.

53. The dispensing container assembly of claim 47 wherein said first nozzle passage completely surrounds said partitioned area.

54. The dispensing container assembly of claim 53 wherein said plunger cup includes an upper surface including channel means communicating with said first nozzle passage and an aperture communicating with said partitioned area.

55. The dispensing container assembly of claim 54 wherein said channel means and said aperture include adjacent end points for common dispensing of said flowable products from said base cup and said partitioned area of said plunger cup respectively.

56. The dispensing container assembly of claim 55 including cover cap means overlying said upper surface of said plunger cup for partially enclosing said channel means and said aperture.

57. The dispensing container assembly of claim 49 including priming means for preventing premature discharge of said flowable product contained within said plunger cup prior to discharge of said flowable product contained within said base cup.

58. The dispensing container assembly of claim 57 wherein said priming means comprises said actuating plunger being initially spaced from said piston and being engageable with said piston only after said plunger cup has been moved a predetermined distance relative to said base cup.

59. The dispensing container assembly of claim 57 wherein said priming means comprises said actuating plunger being initially spaced from said bottom member of said base cup, and being engageable with said piston only after said plunger cup has been moved a predetermined distance relative to said bottom member.

60. The dispensing container assembly of claim 48 wherein said plunger cup includes an outer surface having a predetermined outer configuration, and said base cup includes an inner surface having a corresponding predetermined inner configuration, thereby facilitating slidable movement therebetween.

61. The dispensing container assembly of claim 60 wherein said plunger cup includes a bottom surface and as an aperture extending through said outer surface of said plunger cup at a location spaced from said bottom surface of said plunger cup, whereby said aperture can provide for venting of said plunger cup during filling of said plunger cup with said flowable product and for admission of air between said piston and said bottom surface of said plunger cup to facilitate dispensing of said flowable product from said plunger cup.

62. The dispensing container assembly of claim 61 wherein said predetermined outer configuration of said outer surface of said plunger cup includes at least one longitudinally extending recessed track, and wherein said aperture means is located within said recessed track.

63. The dispensing container of claim 61 wherein said aperture is spaced from said bottom surface of said plunger cup a distance such that prior to said slidable movement of said plunger cup within said base cup said aperture is located adjacent to said piston, whereby said piston covers said aperture.

64. The dispensing container assembly of claim 49 wherein said piston and said actuating plunger are integrally formed into a single unit.

65. The dispensing container assembly of claim 48 wherein said base cup includes a bottom member.

66. The dispensing container assembly of claim 65 wherein said bottom member is separate from said base cup, and wherein said base cup includes locking means for locking said bottom member into said base cup.

67. The dispensing container assembly of claim 66 wherein said locking means comprises one-way locking means for preventing said bottom member from being removed from said base cup.

68. The dispensing container assembly of claim 67 wherein said one-way locking means comprises a pair of inwardly projecting bead members separated by a distance corresponding to the thickness of said bottom member.

69. The dispensing container assembly of claim 48 including removable lid means removably covering said nozzle means.

70. The dispensing container assembly of claim 69 wherein said removable lid means includes hinge means for permanently affixing said removable lid means to said plunger cup adjacent to said nozzle means.

71. The dispensing container assembly of claim 70 wherein said plunger cup includes an outer surface having a predetermined outer configuration, and said base cup includes an inner surface having a corresponding predetermined inner configuration, thereby facilitating slidable movement therebetween.

72. The dispensing container assembly of claim 71 wherein said plunger cup includes a bottom surface and as an aperture extending through said outer surface of said plunger cup at a location spaced from said bottom surface of said plunger cup, whereby said aperture can provide for venting of said plunger cup during filling of said plunger cup with said flowable product and for admission of air between said piston and said bottom surface of said plunger cup to facilitate dispensing of said flowable product from said plunger cup.

73. The dispensing container assembly of claim 72 wherein said predetermined outer configuration of said outer surface of said plunger cup includes at least one longitudinally extending recessed track, and wherein said aperture means is located within said recessed track.

74. The dispensing container of claim 72 wherein said aperture is spaced from said bottom surface of said plunger cup a distance such that prior to said slidable movement of said plunger cup within said base cup said aperture is located adjacent to said piston, whereby said piston covers said aperture.

75. The dispensing container of claim 70 wherein said plunger cup includes a partitioned area for housing said flowable product, said partitioned area having a predetermined inner surface having a shape corresponding to said predetermined shape of said piston.

76. The dispensing container of claim 75 wherein said piston includes an uninterrupted upper surface corresponding to said shape of said predetermined inner surface of said partitioned area of said plunger cup.

77. The dispensing container assembly of claim 76 wherein said piston and said actuating plunger are integrally formed into a single unit.

78. The dispensing container assembly of claim 77 including a plurality of said pistons formed along said surface of said actuating plunger.

79. The dispensing container assembly of claim 70 wherein said base cup includes a bottom member.

80. The dispensing container assembly of claim 79 wherein said bottom member is separate from said base cup, and wherein said base cup includes locking means for locking said bottom member into said base cup.

81. The dispensing container assembly of claim 80 wherein said locking means comprises one-way locking means for preventing said bottom member from being removed from said base cup.

82. The dispensing container assembly of claim 81 wherein said one-way locking means comprises a pair of inwardly projecting bead members separated by a distance corresponding to the thickness of said bottom member.

83. The dispensing container assembly of claim 70 wherein said plunger cup includes an inner surface and said piston is initially disposed at a predetermined location on said inner surface of said plunger cup, and including vent track means in said inner surface of said plunger cup at said predetermined location whereby the creation of an overpressure within said plunger cup during insertion of said piston into said predetermined location is avoided thereby.

84. The dispensing container assembly of claim 83 wherein said vent track means includes a length which is no greater than the thickness of said piston.

85. The dispensing container assembly of claim 84 wherein said vent track means comprises raised guides disposed on said inner surface of said plunger cup.

86. The dispensing container assembly of claim 70 wherein said plunger cup has a predetermined length, and including cover cap means for covering said plunger cup prior to said slidable movement of said plunger cup within said base cup, said cover cap being a length which is greater than said predetermined length whereby said cover cap prevents premature slidable movement of said plunger cup within said base cup.

87. The dispensing container assembly of claim 86 wherein said cover cap means includes an annular rim for mounting said cover cap means on said base cup.

88. A dispensing container assembly comprising:

a base cup;

a plunger cup including a bottom surface telescopingly received in said base cup and relatively slidable therein upon the application of pressure against said plunger cup;

nozzle means communicating with each of said base cup and said plunger cup; .

a piston having a predetermined shape and being slidably movable within said plunger cup, whereby upon slidable movement of said plunger cup within said base cup a flowable product contained within said base cup can be expelled therefrom through said nozzle means and upon slidable movement of said piston within said plunger cup a flowable product contained within said plunger cup can be expelled therefrom through said nozzle means;

an actuating plunger for actuating said slidable movement of said piston upon the application of said pressure against said plunger cup; and a sealing ring removably attachable to said bottom surface of said plunger cup, said sealing ring including an aperture for slidingly receiving and guiding said actuating plunger.

89. The dispensing container of claim 88, including priming means for preventing premature discharge of said flowable product contained within said plunger cup prior to discharge of said flowable product contained within said base cup.

90. The dispensing container of claim 89, wherein said priming means comprises said activating plunger being initially spaced from said piston and being engageable with said piston only after said plunger cup has been moved a predetermined distance relative to said base cup.

91. The dispensing container of claim 88, wherein said base cup includes a bottom member, and said priming means comprises said actuating plunger being initially spaced from said bottom member of said base cup, and being engageable with said piston only after said plunger cup has been moved a predetermined distance relative to said bottom member.

92. The dispensing container assembly of claim 88 wherein said sealing ring has a stepped surface including a first annular portion having a first diameter and including an outer surface frictionally engageable with the inner surface of said plunger cup and a second annular surface having a second diameter and including an outer surface sealingly engageable with said bottom surface of said plunger cup, said second diameter being greater than said first diameter.

93. A dispensing container assembly comprising:

a base cup;

a plunger cup including an outer surface having a predetermined outer configuration, a partitioned area for housing a flowable product, and a bottom surface and being telescopingly received in said base cup and relatively slidable therein upon the application of pressure against said plunger cup;

nozzle means communicating with each of said base cup and said plunger cup; and a piston having a predetermined shape, said partitioned area of said plunger cup having a predetermined inner surface having a shaped corresponding to said predetermined shape of said piston, said piston being slidably movable within said plunger cup, whereby upon slidable movement of said plunger cup within said base cup a flowable product contained within said base cup can be expelled therefrom through said nozzle means and upon slidable movement of said piston within said plunger cup a flowable product contained within said plunger cup can be expelled therefrom through said nozzle means; said plunger cup including an aperture extending therethrough at a location spaced from said bottom surface of said plunger cup, so as to directly connect said plunger cup with the external environment whereby said aperture can provide for venting of said plunger cup during filling of said plunger cup with said flowable product and for admission of air between said piston and said bottom surface of said plunger cup to facilitate dispensing of said flowable product from said plunger cup.

94. The dispensing container assembly of claim 93, wherein said piston includes an uninterrupted upper surface corresponding to said shape of said inner surface of said partitioned area of said plunger cup.

95. The dispensing container assembly of claim 93, wherein said nozzle means includes a first nozzle passage extending longitudinally through said plunger cup separate from said partitioned area for communicating with said flowable product contained within said plunger cup, said first nozzle passage having an axis located outside of said predetermined inner surface of said partitioned area.

96. The dispensing container assembly of claim 95 wherein said nozzle means further includes a second nozzle passage extending longitudinally through said plunger cup separate from said partitioned are for communicating with said flowable product contained within said base cup, said first and second nozzle passages being on opposite sides of said partitioned area and having axes located outside of said predetermined inner surface of said partitioned area.

97. A dispensing container assembly comprising:

a base cup;

a plunger cup including an outer surface having a predetermined outer configuration including at least one longitudinally extending recessed track and a bottom surface and being telescopingly received in said base cup and relatively slidable therein upon the application of pressure against said plunger cup;

nozzle means communicating with each of said base cup and said plunger cup;

a piston having a predetermined shaped and being slidably movable within said plunger cup, whereby upon slidable movement of said plunger cup within said base cup a flowable product contained within said base cup can be expelled therefrom through said nozzle means and upon slidable movement of said piston within said plunger cup a flowable product contained within said plunger cup can be expelled therefrom through said nozzle means; and an actuating plunger for actuating said slidable movement of said piston upon the application of pressure against said plunger cup;

said plunger cup including an aperture extending therethrough at a location space from said bottom surface of said plunger cup a distance such that prior to said slidable movement of said plunger cup within said base cup said aperture is located adjacent to said piston, whereby said piston covers said aperture and said aperture can provide for venting of said plunger cup during filling of said plunger cup with said flowable product and for admission of air between said piston and said bottom surface of said plunger cup to facilitate dispensing of said flowable product from said plunger cup.

98. The dispensing container of claim 97, including priming means for preventing premature discharge of said flowable product contained within said plunger cup prior to discharge of said flowable product contained within said base cup.

99. The dispensing container assembly of claim 98 wherein said priming means comprises said actuating plunger being initially spaced from said piston and being engageable with said piton only after said plunger cup has been moved a predetermined distance relative to said base cup.

100. The dispensing container assembly of claim 98, wherein said priming means comprises said actuating plunger being initially spaced from said bottom member of said base cup, and being engageable with said piston only after said plunger cup has been moved a predetermined distance relative to said bottom member.

101. The dispensing container assembly container assembly of claim 97 wherein said plunger cup includes a bottom surface, and including a sealing ring removably attachable to said bottom surface of said plunger cup, said sealing ring including an aperture for slidingly receiving and guiding said actuating plunger.

102. The dispensing container assembly of claim 97 wherein said piston and said actuating plunger are integrally formed into a single unit.

103. The dispensing container assembly of claim 102 including a plurality of said pistons formed along said surface of said actuating plunger.

104. The dispensing container assembly of claim 98 wherein said bottom member is separate from said base cup, and wherein said base cup includes locking means for locking said bottom member into said base cup.

105. The dispensing container assembly of claim 104 wherein said locking means comprises one-way locking means for preventing said bottom member from being removed from said base cup.

106. The dispensing container assembly of claim 105 wherein said one-way locking means comprises a pair of inwardly projecting bead members separated by a distance corresponding to the thickness of said bottom member.

* * * * *

UNITED STATES PATENT AND TRADEMARK OFFICE

CERTIFICATE OF CORRECTION

PATENT NO. : 4,961,520

DATED : October 9, 1990

INVENTOR(S) : Douglas J. White

It is certified that error appears in the above-identified patent and that said Letters Patent is hereby corrected as shown below:

Column 8, line 15, "FIG." should read --FIG. 1,--.

Column 12, line 25, "x'" should read --x,--.

Column 19, line 45, before "actuating" insert --said--.

Column 19, line 65, delete "45" and substitute therefor --28--.

Column 24, line 3, delete "88" and substitute therefor --89--.

Column 25, line 29 "space" should read --spaced--.

Column 26, line 7, delete "piton" and substitute therefor --piston--.

Signed and Sealed this

Seventeenth Day of March, 1992

*Attest:*

HARRY F. MANBECK, JR.

*Attesting Officer*

*Commissioner of Patents and Trademarks*